US007124888B1

(12) United States Patent
Valdez et al.

(10) Patent No.: US 7,124,888 B1
(45) Date of Patent: Oct. 24, 2006

(54) GOLF BAG RAIN COVER

(76) Inventors: Leonard Victor Valdez, 14812 SE. 170th St., Renton, WA (US) 98058; Michael Wayne Larson, 1132 NW. 64th St., Seattle, WA (US) 98107; Stephen Anthony Krippner, 1148 NW. 59th St., Seattle, WA (US) 98107

( * ) Notice: Subject to any disclaimer, the term of this patent is extended or adjusted under 35 U.S.C. 154(b) by 0 days.

(21) Appl. No.: 11/109,032

(22) Filed: Apr. 19, 2005

(51) Int. Cl.
*A63B 55/00* (2006.01)
*A63B 57/00* (2006.01)

(52) U.S. Cl. ..... 206/315.4; 206/315.3; 206/315.5; 150/159

(58) Field of Classification Search ..... 206/315.3, 206/315.4, 315.5; 150/159; 135/16
See application file for complete search history.

(56) References Cited

U.S. PATENT DOCUMENTS

| | | | | | |
|---|---|---|---|---|---|
| 1,956,008 | A | * | 4/1934 | Deibel | 206/315.6 |
| 2,704,563 | A | * | 3/1955 | Henrich | 150/159 |
| 2,806,711 | A | * | 9/1957 | Jacobs | 280/47.19 |
| 3,059,681 | A | * | 10/1962 | Lorbeski | 150/159 |
| D256,293 | S | * | 8/1980 | Edwards | D3/321 |
| 4,512,465 | A | | 4/1985 | Jobe | |
| 4,522,300 | A | * | 6/1985 | Hamblet | 206/315.4 |
| 4,788,996 | A | | 12/1988 | Forshee | |
| 4,809,724 | A | * | 3/1989 | Fuser | 135/16 |
| 5,159,999 | A | * | 11/1992 | Voigt | 190/111 |
| 5,176,253 | A | * | 1/1993 | Perrin et al. | 206/315.5 |
| 5,406,968 | A | * | 4/1995 | Friedman et al. | 135/16 |
| 5,507,332 | A | | 4/1996 | McKinnon | |
| 5,620,034 | A | | 4/1997 | Flis | |
| 5,718,333 | A | * | 2/1998 | Armour | 206/315.4 |
| 5,947,138 | A | * | 9/1999 | DeAngelis | 135/16 |
| 6,202,850 | B1 | | 3/2001 | Held | |
| 6,283,290 | B1 | | 9/2001 | Thompson | |
| 6,615,982 | B1 | * | 9/2003 | Stewart et al. | 206/315.3 |

FOREIGN PATENT DOCUMENTS

| | | | |
|---|---|---|---|
| CA | 1227394 | * | 9/1987 |
| GB | 2254054 A | * | 9/1992 |
| JP | 200393563 A | * | 4/2003 |

* cited by examiner

*Primary Examiner*—Sue A. Weaver
(74) *Attorney, Agent, or Firm*—Polly L Oliver

(57) ABSTRACT

A golf bag rain cover is used to cover a club opening of a golf bag so that the golfer's clubs can remain as dry as possible during play. The golf bag rain cover may comprise a one-piece shell being constructed of a water-resistant material which is held in a bonnet shape over the club opening by several extensible rods. The golfer simply reaches up and under the shell to retrieve or replace clubs. In alternate embodiments, the deployment of the rain cover can be adjusted to allow more or easier access to the clubs. Also in alternate embodiments, the rain cover may be stowed in a stowage element integral with the golf bag.

13 Claims, 8 Drawing Sheets

GOLF BAG RAIN COVER

FIELD OF THE INVENTION

This invention pertains generally to sporting goods accessories and more particularly to rain covers for golf bags.

BACKGROUND OF THE FIELD

Golf is a popular sport in this country and around the world and is played under all sorts of weather conditions. A golfer needs a cover for his golf bag to keep the clubs dry but accessible to him during play. Many existing golf bag covers are inefficient at keeping the clubs dry or are complicated to use, resulting in less than optimal accessibility.

SUMMARY OF THE INVENTION

The present invention solves the above-mentioned problems by providing a golf bag rain cover which may fit bonnet-like over the club opening of a golf bag. The golf bag rain cover may comprise a water-resistant shell held in shape over the club opening of the golf bag by a plurality of self-tensioning rods, which may or may not be extensible. The shell assembly may be mounted onto the golf bag at the club opening thereof by two generally opposed mounting brackets, or one mounting bracket as well as an integral stowage element, may be provided integral with the golf bag. The invention may be provided as an improvement to a traditional golf bag. (Such traditional golf bags are generally cylindrically shaped and have a club opening at one end and are closed at the other.)

DETAILED DESCRIPTION

Figure 1A:
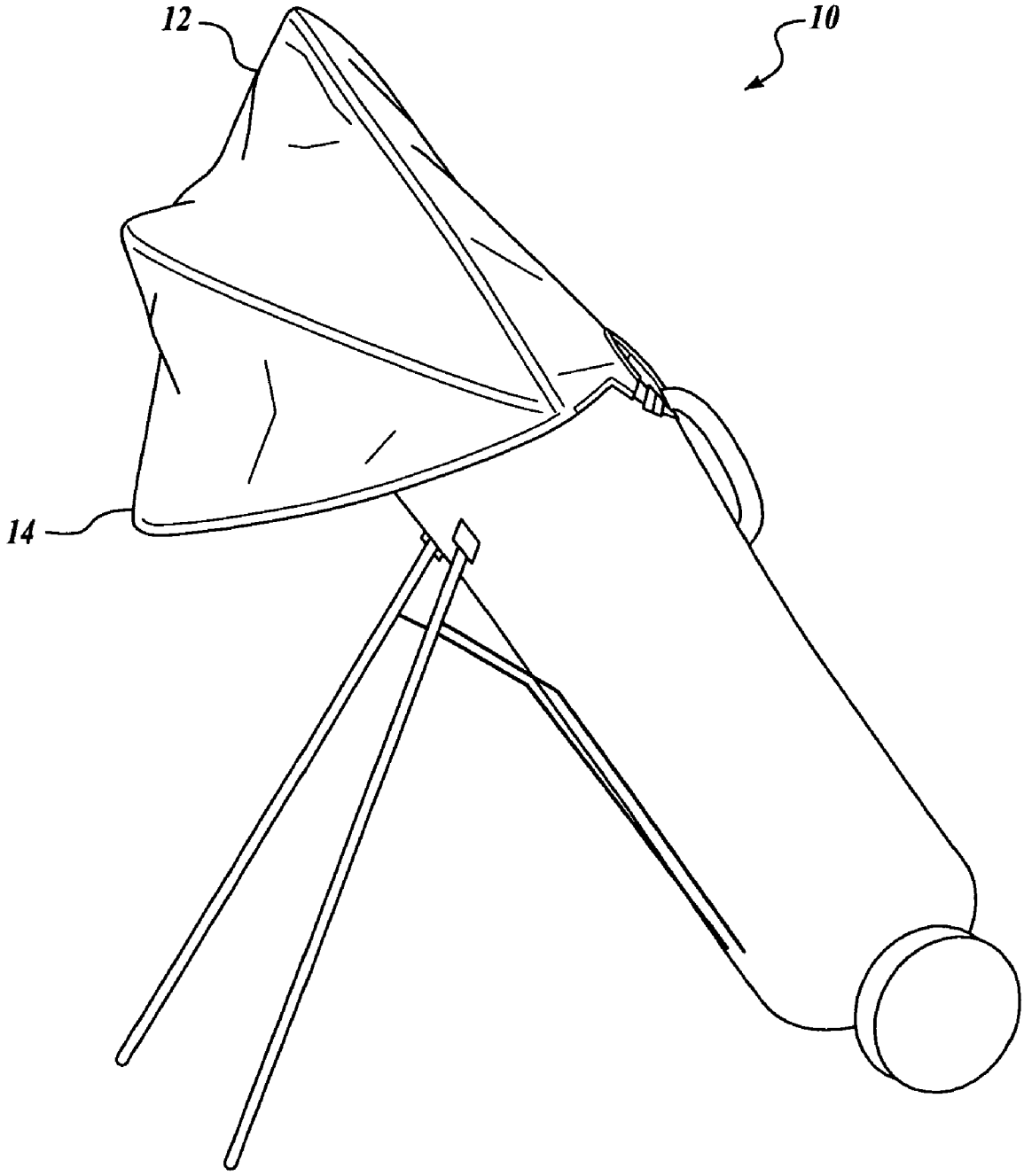
FIG. 1A is a perspective view of the golf bag rain cover in a deployed, closed position.
Figure 1B:
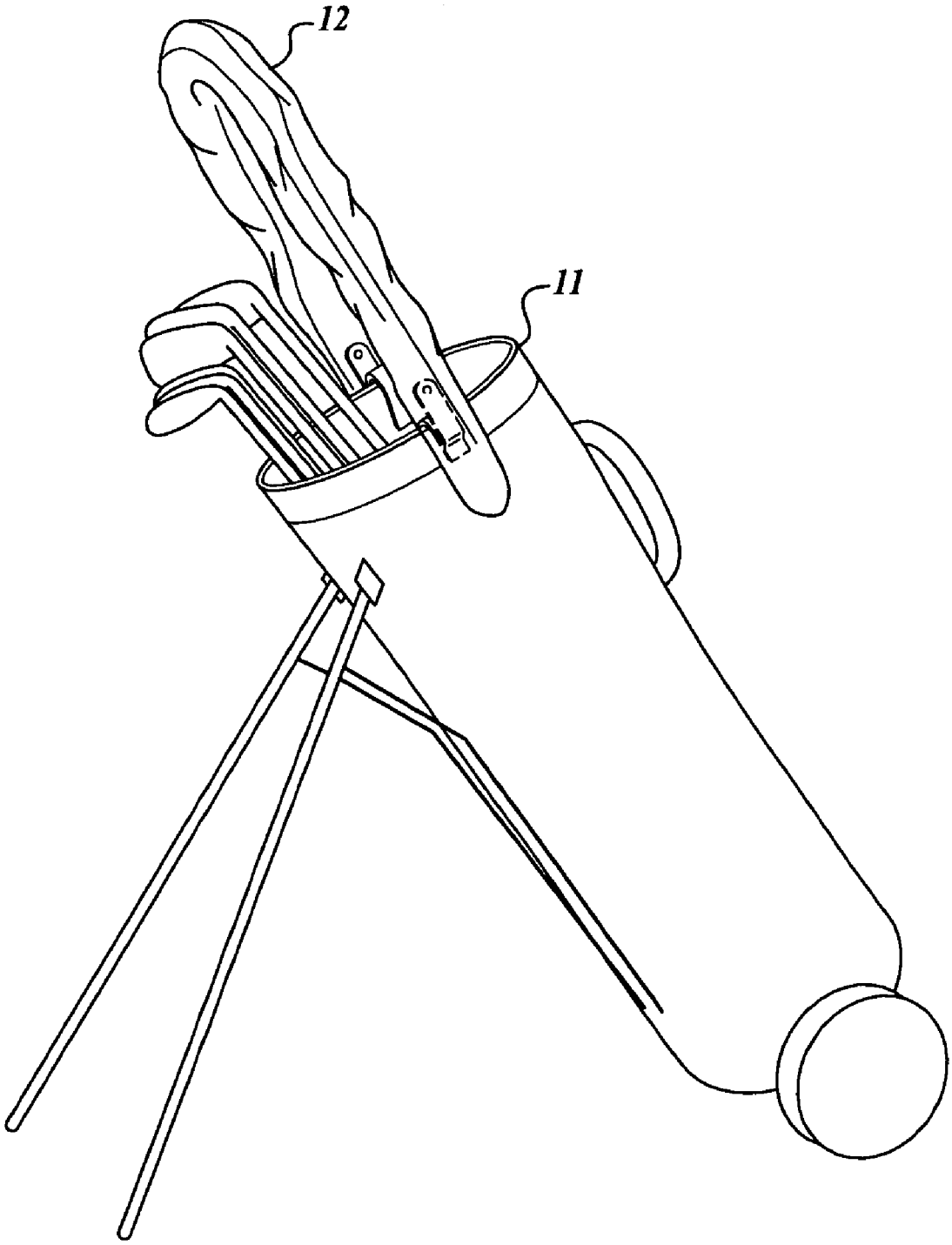
FIG. 1B is a perspective view of the golf bag rain cover in a collapsed, open position.

FIG. 1A shows the golf bag rain cover 10 in the deployed and closed position as it is to be installed over the club opening 11 of a golf bag. In this position, the cover 10 will effectively keep the club heads, as well as the club grips, dry and ready for use by the golfer. For the purpose of these illustrations and this accompanying narrative, the reference frame used will be defined as follows: whether or not the golf bag is held at an angle, and regardless of the installation orientation of the cover thereon, the front of the golf bag will correspond to the front of the rain cover, i.e., the side towards which the bowed rods automatically fall (gravity action); and the rear of the golf bag will correspond to the rear of the rain cover, i.e., the side defining the closure panel. The water-resistant shell 12 is held in a bonnet-like shape and is supported by a plurality of self-tensioning, extensible rods 14 (shown in more detail in following figures) which are bowed over the club opening 11, and the shell 12 can be opened as shown in FIG. 1B to provide access to the clubs, by collapsing the rods 14 towards the rear of the golf bag. (Although the shell 12 may be initially provided in several panels, the panels may be sewn, fused, or otherwise fastened together to provide a one-piece shell 12 which surmounts the bowed rods.) Alternatively, the golfer does not have to collapse the cover 10 into the fully open position as shown in FIG. 1B, but can simply reach up under the closed shell 12 to retrieve the desired club while leaving the remaining clubs protected by the rain cover 10. In the illustrative embodiment, a set of three extensible rods 14 is used with the shell 12, each rod having a first end and a second end. The first ends are all held together in a set, and the second ends are all held together in a set. The first set of rod ends 22 is linked to a first mounting bracket 20, and the second opposing set of rod ends 24 is linked to a second opposing mounting bracket 21. The two mounting brackets will then be attached to opposing portions of the golf bag.

Figure 2A:
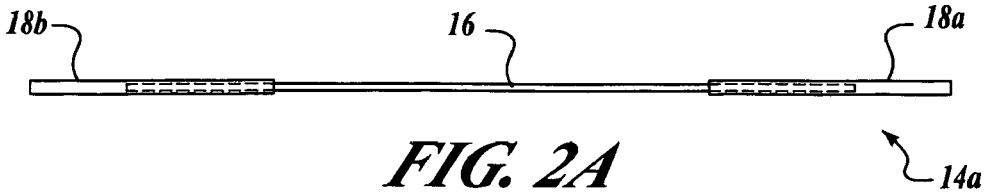
FIG. 2A is a detail view of an extensible rod in contracted, straight position.
Figure 2B:
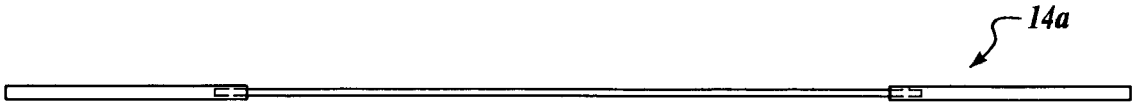
FIG. 2B is a detail view of an extensible rod in extended, straight position.
Figure 2C:
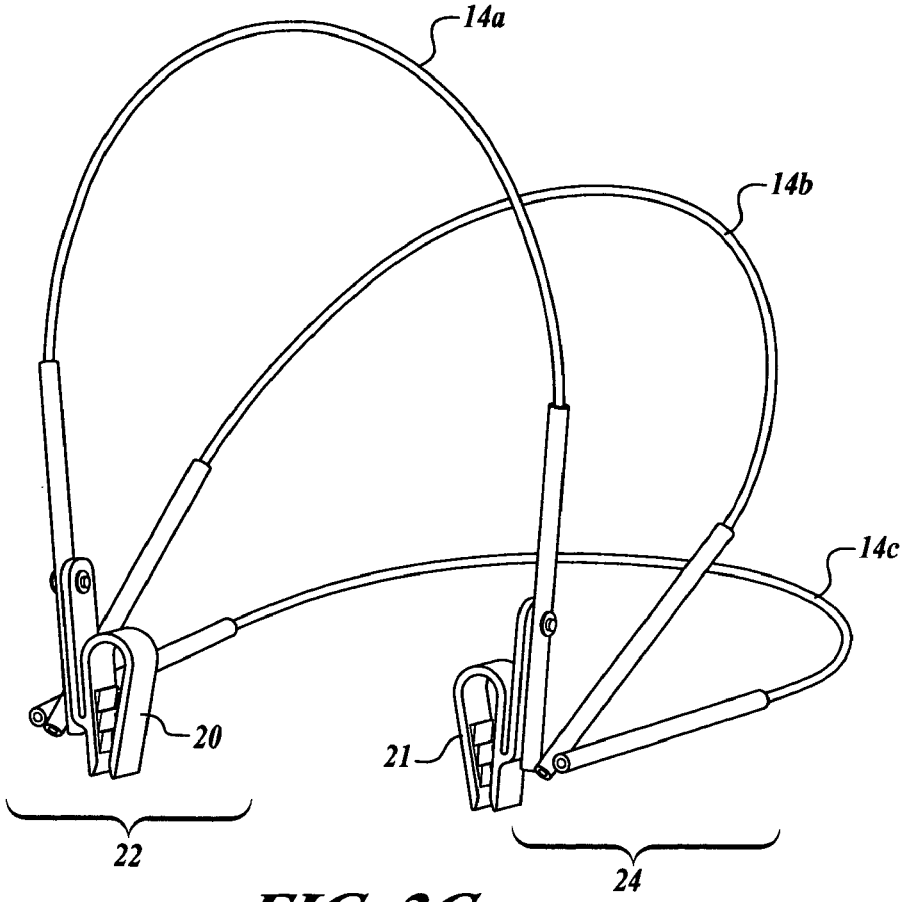
FIG. 2C is a detail view of three extensible rods in extended, bowed position.

Although any number of rods, extensible or not, could be used to practice the invention, an optimal number here illustrated and discussed is three. (For instance, as alluded to in the alternate configuration here presented, two rods could be effectively used.) FIG. 2A shows one (14*a*) of a set of three extensible rods 14*a*, 14*b*, and 14*c*. In this FIG. 2A, the rod 14*a* is contracted to a maximum extent, the extent to which it will be contracted and shortened when the shell 12 is in the stowed position, e.g., for stowage in a storage sheath (e.g., a sheath separate from the golf bag or a stowage tube or other element integral with the golf bag). When contracted, the outer portions 18*a* and 18*b* of the rod 14*a* slide onto the inner portion 16, and when extended, the outer portions 18*a* and 18*b* slidably extend from the inner portion 16. FIG. 2B shows the same rod 14*a* of the set of three extensible rods 14*a*, 14*b*, and 14*c* in the extended and straight position; and FIG. 2C shows the set of rods 14*a*, 14*b*, and 14*c* in the extended and bowed position, as they will be bowed when the shell 12 is in the deployed, closed position of FIG. 1A. The rod ends (ends of the outer portions) are positioned proximate each other and may be held within pockets 28 of the shell 12. Likewise, the inner portions 16 of the rods 14 may be at least partially held within similar shell pockets or loops.

Figure 3:
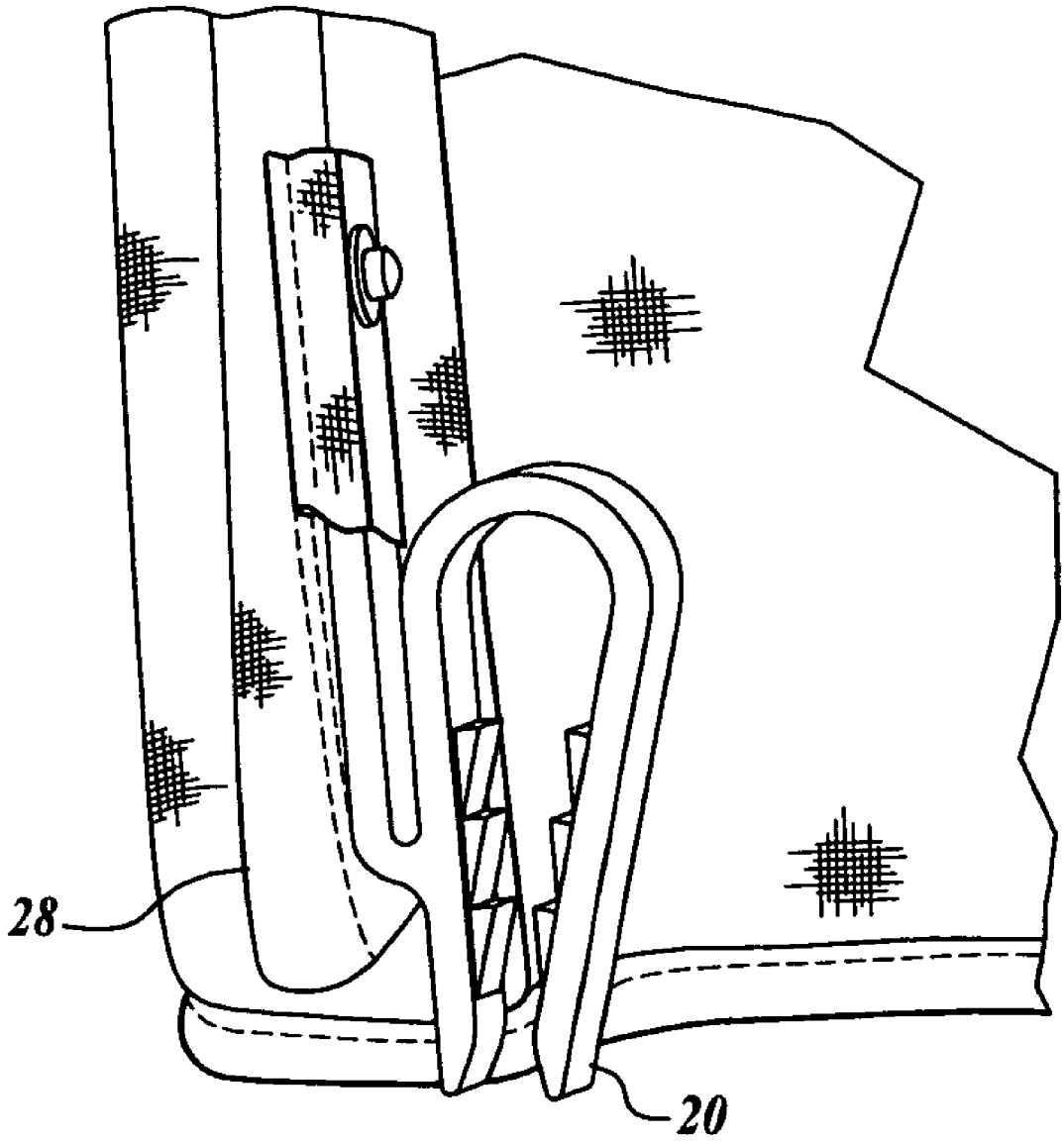
FIG. 3 is a detail view of a mounting bracket.

Although there will be two mounting brackets 20 and 21 linked to the ends of the rods 14, and located on the golf bag at the club opening, for clarity and for illustration purposes, only one mounting bracket 20 is shown in FIG. 3. It is understood that the second, opposing mounting bracket 21 will be a mirrored complement to the first illustrated. It is also understood that although the mounting brackets 20 and 21 of the embodiment shown here are clips that can be easily installed and removed from the golf bag, any other type of suitable mounting bracket may be used, including a mounting bracket that is permanently mounted to the golf bag at the club opening 11 thereof. In the illustrative embodiment, the three rods 14 (14*a*, 14*b*, and 14*c*) are used with and support the shell 12, the first set of rod ends 22 being linked to one mounting bracket 20 and the second opposing set of rod ends 24 being linked to a second opposing mounting bracket 21. The mounting bracket 20 is designed to hold the first rod 14*a* in a fixed relation; this rod 14*a* when extended and bowed into the deployed position will be oriented toward the rear of the golf bag club opening 11 and will retain its position whether the cover 10 is opened or closed. The second and third rods 14*b* and 14*c* are held in a pivoting relation to the first mounting bracket 20 and also to the first rod 14*a*. All rods ends may be retained in pockets 28 of the shell 12 (or alternatively may be held together by a pivot pin or other device) and so will fall forward (gravity action) when the brackets 20 and 21 are installed allowing the shell 12 to completely deploy and cover the golf bag club opening 11. Alternatively to the shell, the mounting bracket 20 itself may be designed to hold the second and third rods 14*b* and 14*c* in such a pivoting relation; these rods 14*b* and 14*c*, when extended and bowed into the deployed, closed position, will be oriented toward the front of the golf bag club opening 11 and will be capable of collapsing to be adjacent the first rod 14*a* to provide club access.

The mounting brackets 20 and 21 may be removable from the golf bag as in the embodiment shown and/or be permanently fixed to the rod ends or to the shell 12 itself. Alternatively, the mounting brackets 20 and 21 may be fixed onto the golf bag proximate the club opening 11, so that they will always be available for accepting the two sets of rod ends 22 and 24, and thereby deploying the golf bag rain cover 10. Alternatively, the mounting brackets 20 and 21 may be held by a strap which circumscribes the golf bag proximate the club opening 11. If such a strap is used, then the strap may be removed in fair weather (e.g., for the summer season) and installed in harsher weather (e.g., for the fall, winter, or spring seasons). Regardless of the means of attaching the mounting brackets 20 and 21 to the golf bag, the linkage between bracket and rods may be such that at least one fixed rod 14*a* is oriented toward the rear of the club opening 11.

Figure 4:
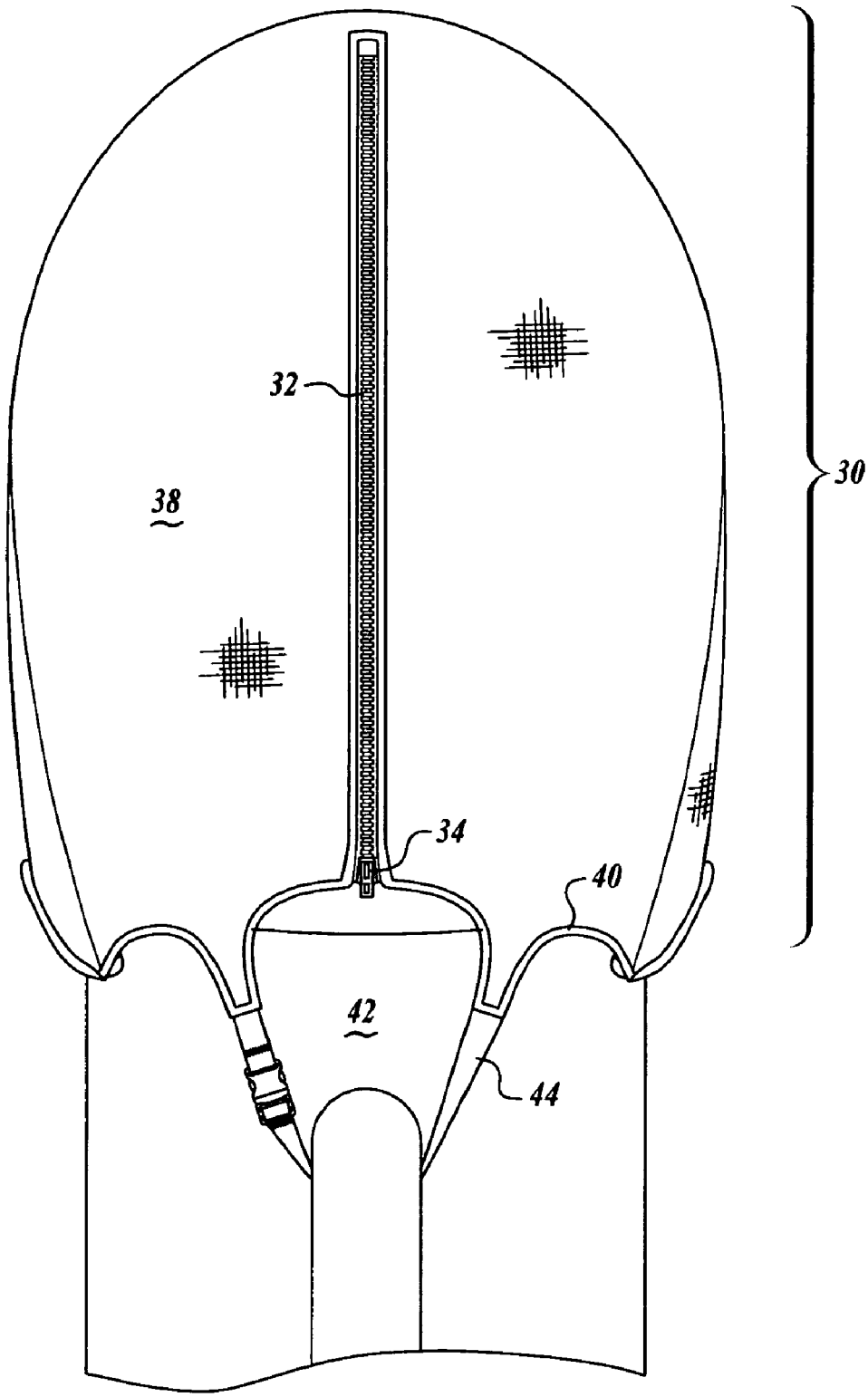
FIG. 4 is a back view showing the rear shell closure fastened.

FIG. 4 is a back view of the rain cover 10 and shows a detail of the rear shell closure 30 within the rear panel 38 (which may preferably be constructed of the same water-resistant material as the rest of the shell). This rear shell closure 30 may be accomplished with a zipper 32 as shown, or may be accomplished with a variety of other methods, e.g., hook-and-loop fasteners such as Velcro™, snaps, or overlapping flaps. (The rear panel 38 is typically defined by the shell 12 on all but the lower edge 40. Alternatively, in the case of a surmounting shell held atop bowed rods, the rear panel 38 may simply depend from the shell.) The zipper 32 closes the rear panel 38 of the rain cover to a point proximate the lower edge 40 of the rear panel, defining an opening 42 to accommodate a golf bag handle or shoulder strap. It is optimal, though not requisite for the practice of the invention, that the zipper 32 descend far enough that the zipper tab 34 locate at or below the club opening 11 so that no rain can enter though the opening 42 onto the golf clubs. The lower edge 40 of the rear panel therefore locates proximate the club opening of the golf bag. An adjustable retention strap 44 attached to the rear panel 38 of the rain cover proximate the lower edge 40 fastens under such golf bag handle or shoulder strap to complete the circumscription of the opening 42. Alternatively, the zipper tab 34 (or flap end, bottom snap, etc.) may be fastened to the golf bag for added retention and rain resistance (for instance on a windy day). Fastening the closure 30, and fastening the retention strap 44, zipper tab 34, or snap, etc., not only assists in retaining the rain cover 10 to the golf bag and in eliminating space between the cover and the golf bag, but also adds an amount of tension to the rear panel 38 of the shell 12, so as to maintain the bonnet-shape of the shell 12 as installed on the golf bag. When the closure 30 is unfastened, the tension will be released, and the rear panel 38 will be loose and capable of being stowed (i.e., the rods 14 will be allowed to straighten out from the deployed position (bowed) in order to contract into the straight, stowable position of FIG. 2A).

Figure 5A:
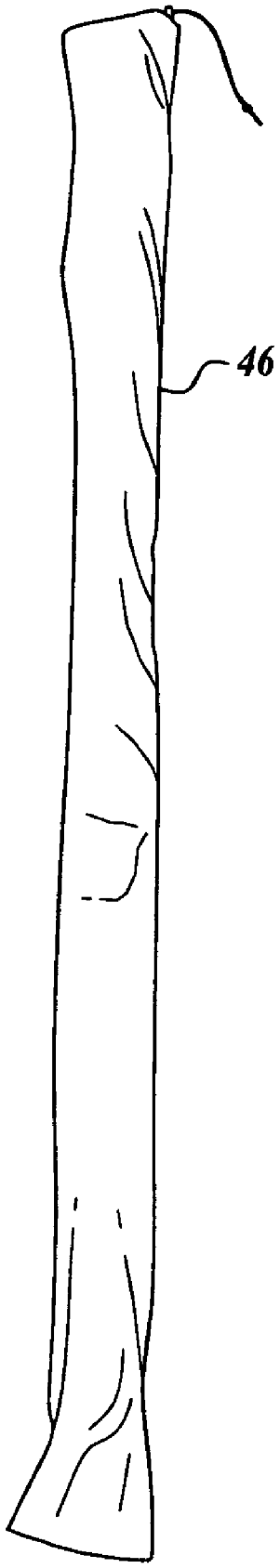
FIG. 5A is a perspective view of a rain cover storage sheath separate from a golf bag.

The golf bag rain cover 10 is intended to be stowed in or proximate to (even adjacent) the golf bag, and in the stowed position, the inner portion 16 slides into and nests with the outer portions 18*a* and 18*b* in order to accommodate the difference in length between the stowed (straight and contracted) and in use (extended and bowed) configurations. (The contracted rods 14 can now be stowed in a storage sheath 46, shown in FIG. 5A, along with the shell 12 to await future use.) In alternate embodiments, any other suitable method for contracting and extending the rod length could be designed, e.g., telescoping, folding, etc.

Figure 5B:
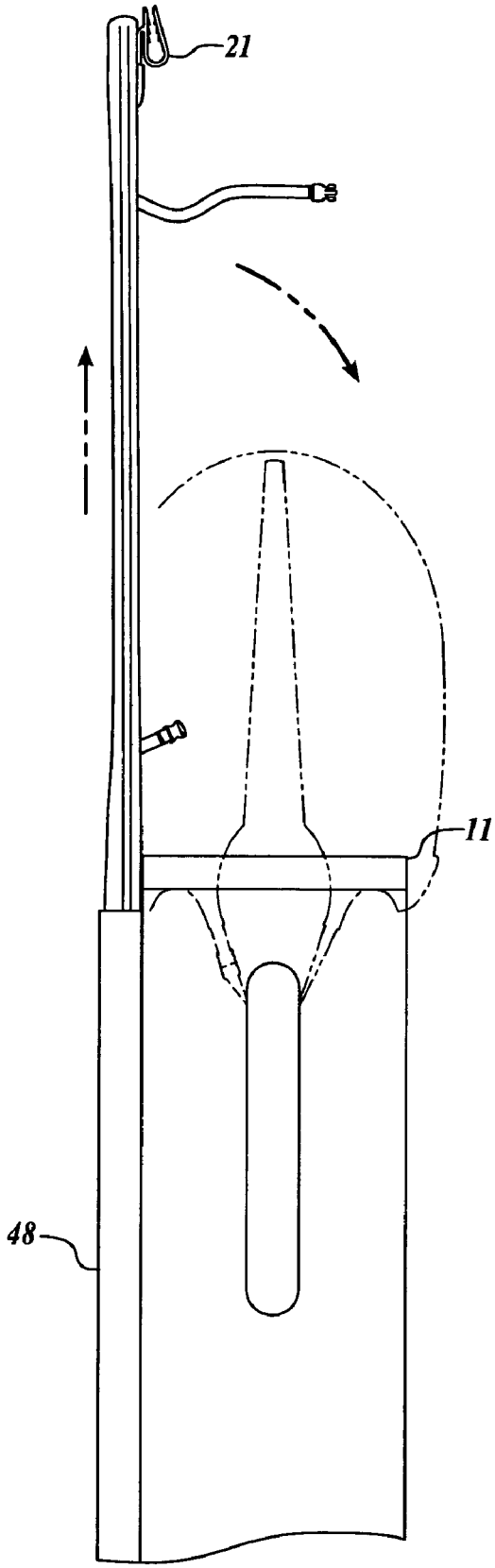
FIG. 5B is a back view of a rain cover stowage element integral with a golf bag.

FIG. 5B shows an alternate embodiment of a stowage element 48, such as a tube, being fastened to or integrated with the side of the golf bag and the rain cover 10 being removably housed therein and deploying therefrom. The stowage element 48 may have an open end proximate or adjacent the club opening of the golf bag and a closed distal end spaced therefrom, and the stowage element 48 may be located on the interior or the exterior of the golf bag. In this embodiment, the entire rain cover, including at least one mounting bracket, may slide out of and be separated from the stowage element (and then mounted onto the club opening), or the rain cover may slide out of the proximate end of the stowage tube 48, and then the proximate end of the stowage tube may itself function as one of the two mounting brackets (by engaging and retaining the first mounting bracket attached to the rain cover). The opposing mounting bracket may be linked to the opposed rod ends and removably attach onto the opposing side of the club opening 11. Alternatively, the opposing mounting bracket may be permanently fixed to the appropriate location on the club opening 11, and the rod ends would simply deploy from the storage tube 48 and link to said mounting bracket.

Figure 6:
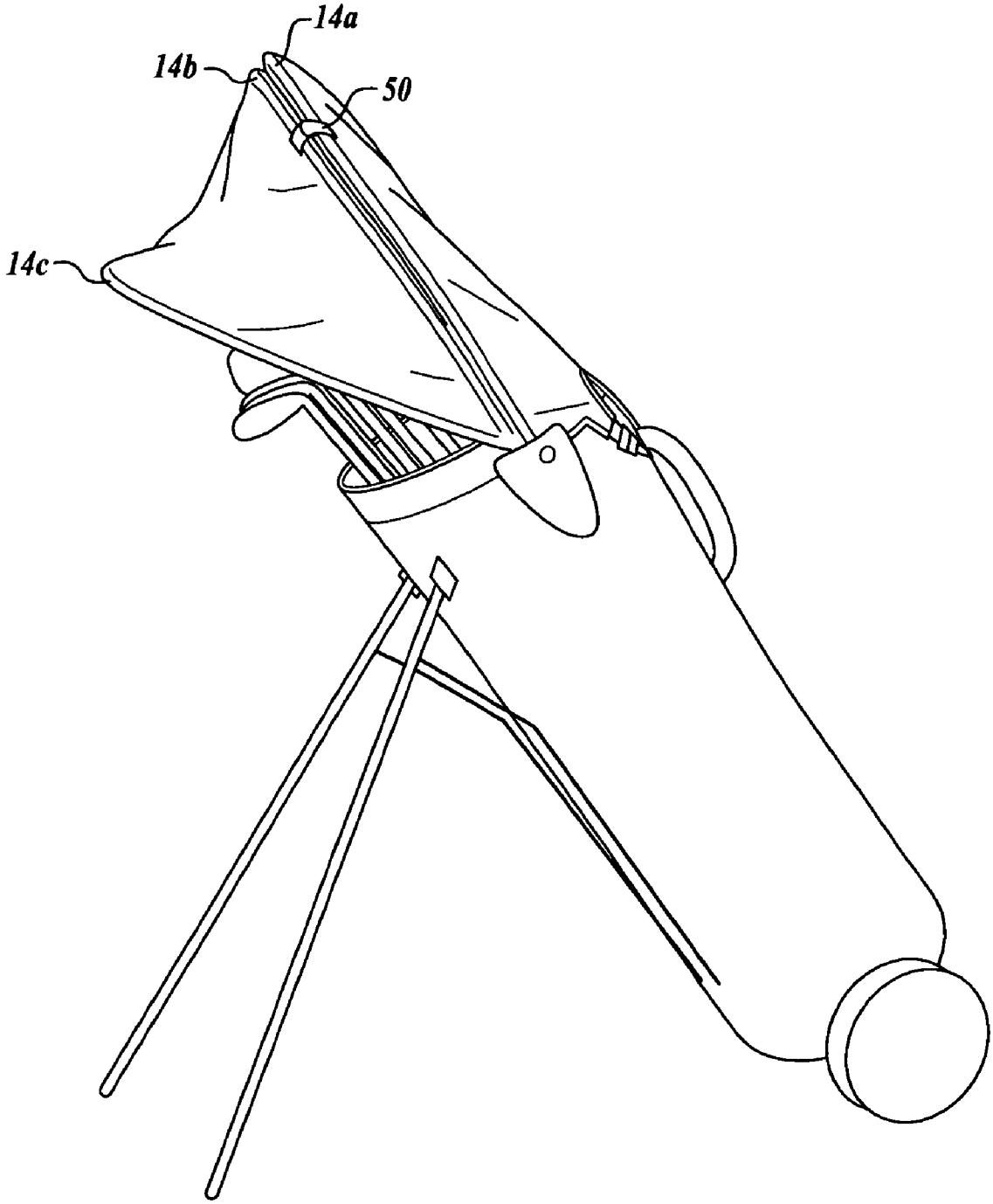
FIG. 6 is a perspective view of an alternate embodiment.

FIG. 6 shows an alternate embodiment in which one of the extensible rods 14 (in this figure, the middle/second rod 14*b*) may be collapsible and retained in closer proximity to an adjacent rod (in this figure, the rearward/first rod 14*a*). In this way, the rain cover 10 may be partially collapsed to accommodate some pull cart configurations, some light rain situations, or other circumstances. One way to accommodate such retention may be to use strategically placed hook-and-loop fasteners 50 such as Velcro™. Any other suitable method may be used.

It is appreciated that various modifications to the inventive concepts described herein may be apparent to those skilled in the art without departing from the spirit and scope of the present invention as defined by the hereinafter appended claims.

What is claimed is:

1. A golf bag rain cover for use in covering a club opening of a golf bag comprising:

a one-piece shell, said shell being constructed of a water-resistant material and being maintained over said club opening of said golf bag, said shell defining a rear panel with a closure therein;

a plurality of extensible rods supporting said shell, each of said rods having a first end and a second end, the first ends being linked to a first mounting bracket attached to one portion of the golf bag and the second ends being linked to a second mounting bracket attached to an opposing portion of the golf bag, each of said rods comprising an inner portion slidably inserted between outer portions at said first end and said second end.

2. The golf bag rain cover of claim 1 wherein said shell is supported by said extensible rods in a bonnet shape over said club opening of said golf bag and said extensible rods are bowed over said opening into said bonnet shape.

3. The golf bag rain cover of claim 1 wherein said shell is constructed of a plurality of pieces of water resistant material being fastened together.

4. The golf bag rain cover of claim 1 wherein said rear panel is also constructed of water-resistant material and is fastened to said shell such that a lower edge of the rear panel locates proximate the club opening of the golf bag.

5. The rain cover of claim 4 wherein the closure of the rear panel is fastened with a zipper, said zipper being oriented so that when closed, the tab of the zipper will be proximate the club opening of the golf bag.

6. The rain cover of claim 4 further comprising an adjustable retention strap attached to said rear panel proximate the lower edge thereof.

7. The golf bag rain cover of claim 1 wherein there are two extensible rods, each of said rods comprising an inner portion slidably inserted between outer portions at said first end and said second end.

8. The golf bag rain cover of claim 1 wherein at least two of said rods are held in a pivoting relation to said mounting brackets.

9. The golf bag rain cover of claim 8 further comprising means for retaining one of said rods in closer proximity to another of said rods.

10. The golf bag rain cover of claim 1 wherein the mounting brackets comprise removable clips, said first ends of said extensible rods being linked to a first of said clips, and said second ends of said extensible rods being linked to a second of said clips.

11. A golf bag rain cover for use in covering a club opening of a golf bag comprising:

a one-piece shell, said shell being constructed of a water-resistant material and being maintained over said club opening of said golf bag, said shell defining a rear panel with a closure therein;

a plurality of extensible rods supporting said golf bag shell, each of said rods having a first end and a second end, the first ends being linked to a first mounting bracket and the second ends being linked to a second mounting bracket, each of said rods comprising an inner portion slidably inserted between outer portions at said first end and said second end allowing said rods to define a contracted state and an extended state, said rain cover being removably housed within a generally tubular stowage element integral to and permanently affixed to said golf bag, said stowage element having an open proximate end located adjacent the club opening.

12. The golf bag rain cover of claim 11 wherein said first mounting bracket is slidably engaged within the stowage element.

13. In a traditional generally cylindrically shaped golf bag having a club opening at one end, the improvement comprising:

a generally tubular stowage element mounted integrally with the golf bag, said element having an open end proximate the club opening;

a golf bag rain cover slidably mounted within said stowage element and deployable therefrom, said rain cover comprising a water-resistant shell surmounting a plurality of extensible rods having first ends and second ends, said first ends being attached to a sliding mounting bracket engageable with said proximate end of said stowage element, said second ends being attached to a mounting bracket removably linked to an opposing side of said club opening, each of said rods comprising an inner portion slidably inserted between outer portions at said first end and said second end.

* * * * *